US005637059A

United States Patent [19]

Dalebout

[11] Patent Number: 5,637,059

[45] Date of Patent: Jun. 10, 1997

[54] ADJUSTABLE MULTIPURPOSE BENCH

[75] Inventor: William T. Dalebout, Logan, Utah

[73] Assignee: ICON Health & Fitness, Inc., Logan, Utah

[21] Appl. No.: 379,786

[22] Filed: Jan. 27, 1995

[51] Int. Cl.[6] ..... A63B 21/00

[52] U.S. Cl. ..... 482/52; 482/142; 482/148; 482/108

[58] Field of Search ..... 108/116, 118, 108/129, 1, 4, 5, 6, 8, 9, 137, 131, 132; 297/423.46, 423.45, 423.44; 248/396; 482/142, 108, 52, 51, 130, 132, 148

[56] References Cited

U.S. PATENT DOCUMENTS

| | | | |
|---|---|---|---|
| 225,352 | 3/1880 | Mott | 108/116 |
| 336,156 | 2/1886 | Pursell | 248/396 |
| 353,459 | 11/1886 | Newcomb | 108/9 |
| 2,850,081 | 9/1958 | Dillion | 108/118 |
| 3,136,269 | 6/1964 | McDonald | 482/142 |
| 3,653,715 | 4/1972 | Drabert et al. | 248/188.2 |
| 4,597,553 | 7/1986 | Rorabaugh . | |
| 5,190,513 | 3/1993 | Habing et al. . | |
| 5,232,426 | 8/1993 | Vanstraaten | 482/142 |
| 5,272,825 | 12/1993 | Simpson | 108/118 |

FOREIGN PATENT DOCUMENTS

| | | |
|---|---|---|
| 1256137 | 6/1989 | Canada . |
| 1289156 | 9/1991 | Canada . |
| 2639307 | 3/1978 | Germany . |
| 3417719 | 11/1985 | Germany . |

OTHER PUBLICATIONS

Atlantic Fitness Products, Nov. 1, 1985, p. 40 #1007.
Advertisement for Weslo Stack Rack—1992.
Gold's Gym Brochure—date unknown.
Diversified Products 1991 Catalog—Cover page and p. 41.

*Primary Examiner*—Jerome Donnelly
*Attorney, Agent, or Firm*—Trask, Britt & Rossa

[57] ABSTRACT

An exercise bench has a platform with a bracket extending thereunder. Two substantially tubular legs extend thereunder and rotate about separate axles. Pins are connected to two arms which in turn are connected to a torsion bar to urge the pins into registration with apertures or support surfaces of the legs. A handle is connected to the two arms for operation by the user to move the pins and adjust the leg positions. Free weights are attached to one of the legs for use in the performance of exercises.

30 Claims, 5 Drawing Sheets

ADJUSTABLE MULTIPURPOSE BENCH

BACKGROUND OF THE INVENTION

1. Field of the Invention

This application relates to exercise benches more particularly exercise benches with legs that can be adjusted in height.

2. State of the Art

A wide variety of exercise bench devises have been configured to support a user in a sitting or reclining position to perform exercises. Weight-lifting benches are one type of such bench.

Benches have also been devised for the user in performing stepping exercises. More specifically the step benches are positioned at an elevation slightly above the support surface (e.g. floor) and configured for the user to step onto and from in the performance of stepping type exercises as well as other types of exercises.

An exercise bench is desired that may be easily reconfigurable into a variety of configurations for use in performing sitting, stepping and reclining exercises as desired by the user.

SUMMARY

An exercise bench includes a platform sized to receive a user thereon. A bracket is secured to the platform to extend away therefrom. A first leg has a first end rotatably connected to the bracket and the second end configured for placement on a support surface. The first leg is moveable between the first position and the second position rotatably spaced from the first position.

The exercise bench also includes a second leg having a first end rotatably connected to the bracket and a second end configured for placement on a support surface. The second leg is also moveable between a first position and a second position rotatably spaced from the first position.

The exercise bench also has securing means to secure the first leg and the second leg in their respective first and second positions.

Desirably the first leg means and the second leg means are in general axial alignment. The first leg means preferably includes a first leg member with a first foot member attached proximate the distal end thereof. The second leg means preferably includes a second leg member with a second foot member attached proximate to the distal end thereof.

In a desirable arrangement, the securing means includes a first retaining member for retaining the first leg member in at least the first position. The first leg member has a surface to contact the retaining member to support the first leg member in at least the first position. The securing means may also include a second retaining number for retaining the second leg in at least its first position. The second leg member also has a surface to contact the retaining member to support the second leg member in at least its first position.

The securing means also preferably includes a first axle and a second axle to rotatably connect the first leg member and the second leg member to the bracket.

In a preferred arrangement, the surface of the first leg member includes at least one first aperture formed or mechanically connected to the first leg member. The surface of the second leg member includes at least one second aperture formed in or mechanically connected to the second leg member. The first retaining member is a first pin for removable connection with the first surface including the first aperture. The second retaining member is a second pin for removable connection with the second surface including the second aperture.

Desirably, the first pin is connected to a first arm and the second pin is connected to a second arm. A handle may be connected to the first arm and the second arm to remove the first pin and the second pin so the first leg member and second leg member may be rotated between positions.

A spring such as torsion bar may be connected to the first arm and the second arm to urge the first pin and the second pin into position for contact with the respective surface of the first leg member and the second leg member.

In a preferred arrangement the first leg member is tubular and has a first foot member that extends transverse to the first leg member. Similarly, the second leg member is tubular and has a second foot member extending transverse thereto.

The platform desirably has a length and width and is generally rectilinear in projection. The first foot member and the second foot member are each preferably sized to extend at least the width of the platform. Similarly, the first leg member and the second leg member are each sized in length to extend together approximately the length of the platform with the first leg member and the second leg member each positioned in their respective second positions.

In an alternate configuration, the first position of the first leg member and the second leg member are in general axial alignment with the platform.

In an alternate arrangement, the first leg member has a plurality of brackets sized to snugly and removably receive a plurality of hand exercise weights.

Desirably the exercise bench is formed in width to comfortably receive a sitting or reclining user. More specifically it is sized in width from about 18 inches to about 24 inches and in length from about 30 inches to about 36 inches.

BRIEF DESCRIPTION OF THE DRAWINGS

In the drawings which illustrate what is presently regarded as a preferred embodiment for carrying out the invention.

DETAILED DESCRIPTION OF THE ILLUSTRATED EMBODIMENT

Figure 1:
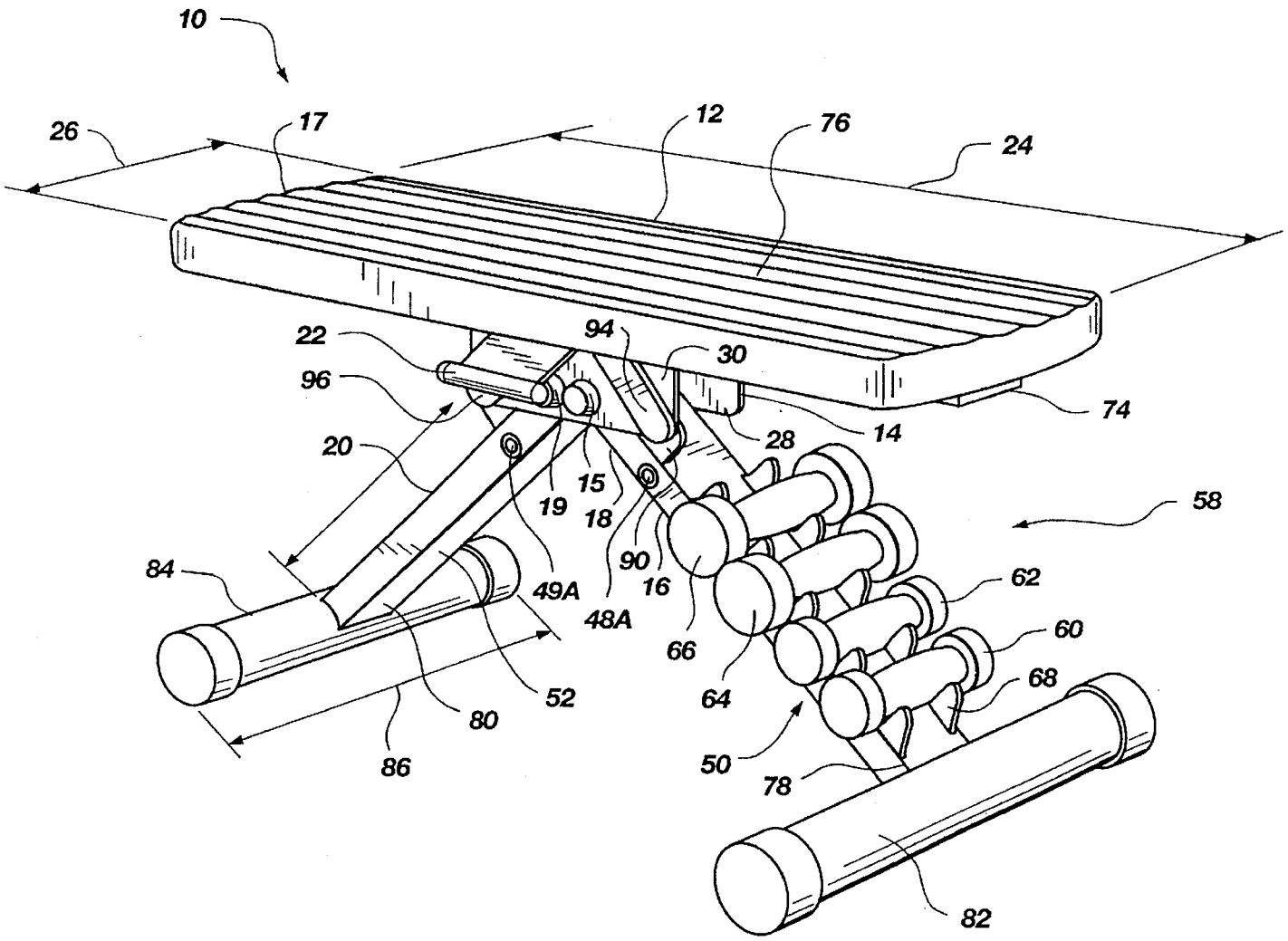
FIG. 1 is a perspective view of an exercise bench of the present invention in a first position.

The exercise bench 10 of FIG. 1 has a platform 12 sized to receive a user thereon. A bracket 14 is secured underneath the platform 12 to extend away therefrom.

Figure 2:
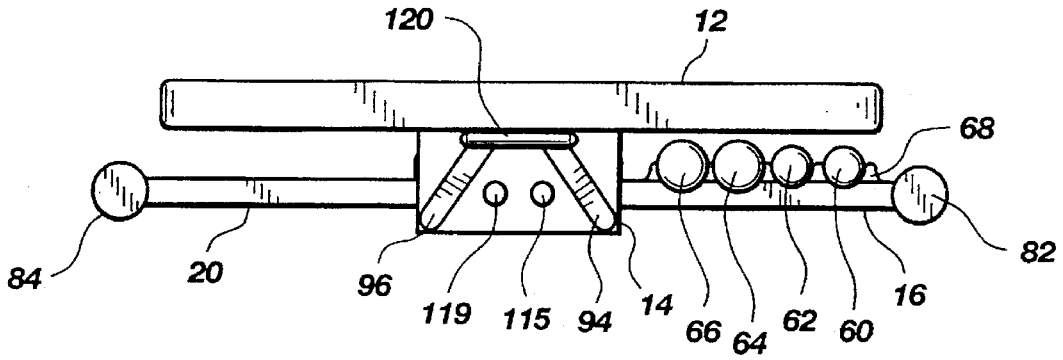
FIG. 2 is a schematic representation of an exercise bench of FIG. 1 in a second position.
Figure 3:
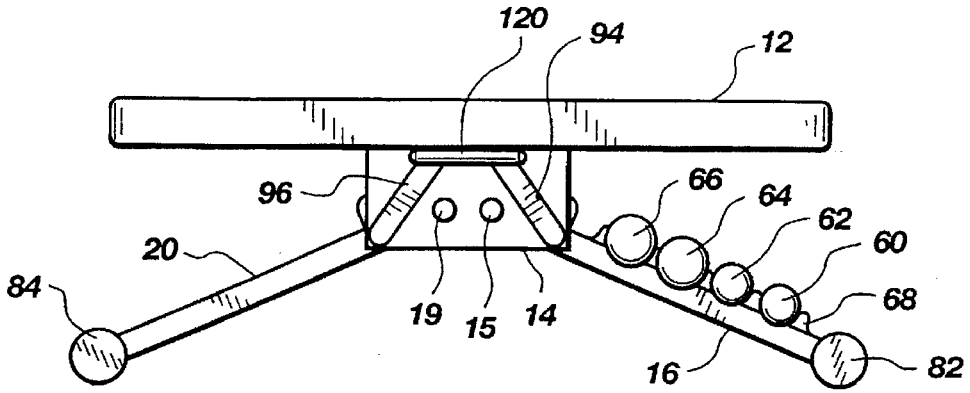
FIG. 3 is a schematic side view of an exercise bench of FIG. 1 in an alternate first position.
Figure 4:
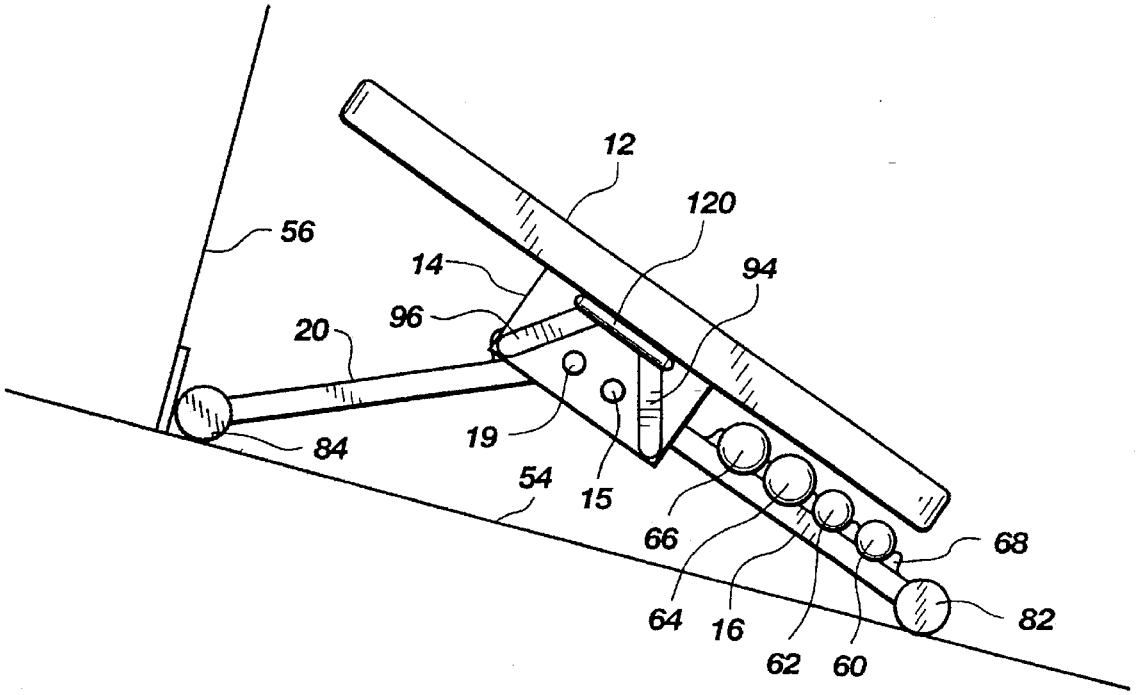
FIG. 4 is a schematic side view of an exercise bench of FIG. 1 in an alternate position.

The exercise bench 10 includes a first leg means to support the unit on a support surface. The first leg means here illustrated has a first leg member 16 which has a first end 18 rotatably connected to the bracket 14 to rotate about axle 15. The first leg member 16 is rotatable between a first position here illustrated in FIG. 1 and a second position such as that shown in FIG. 2. Alternate positions are also shown in FIGS. 3 and 4.

The exercise bench 10 of FIG. 1 also includes a second leg means for supporting the platform 12 on a support surface. As illustrated in FIG. 1, the second leg means includes a second leg member 20 rotatably connected to the bracket 14 by the axle 19. The second leg member 20 is rotatable between a first position shown in FIG. 1 and a second position shown in FIG. 2. Alternate positions are also shown in FIGS. 3 and 4.

Securing means is also provided to secure the first leg means and the second leg means in their respective first and second positions. As here shown, the securing means includes a first retaining member for retaining the first leg member in at least the first position as more fully discussed hereinafter with respect to FIGS. 5, 6 and 7. Similarly the securing means includes a second retaining member for retaining the second leg member 20 in at least its first position as can be seen more clearly in FIGS. 5, 6 and 7 and as more fully discussed hereinafter.

As can be seen in FIG. 1, the platform 12 is generally rectilinear in projection having a length 24 and a width 26. As here shown, the length is approximately 30 inches but may extend from approximately 30 inches to approximately 36 inches. Similarly the width 26 as here shown is approximately 18 inches but may extend up to 24 inches. It may also be understood that the length 24 and width 26 may vary and are selected to accommodate the user in sitting as well as in reclining positions. Further, the platform 12 may be formed in other geometric shapes including, for example, elliptical (in projection) and circular (in projection) shapes.

The platform 12 as shown is formed to have a metal base (not shown) with a rubberized or generally high friction surface. Alternately the platform may be formed out of a sufficiently strong plastic or other suitable substantially rigid material as desired by the user. As can be seen, the high friction surface 76 is formed with a plurality of grooves 17 to increase friction and reduce, for example, foot slippage.

The bracket 14 as here shown has a right member 28 and a left member 30 spaced apart underneath the bench and sized to receive the first leg member 16 and the second leg member 20 therein between. Alternate configurations of brackets 14 may be used as desired so long as they are sufficient to provide the desired transverse and longitudinal support to the legs 16 and 20.

Figure 5:
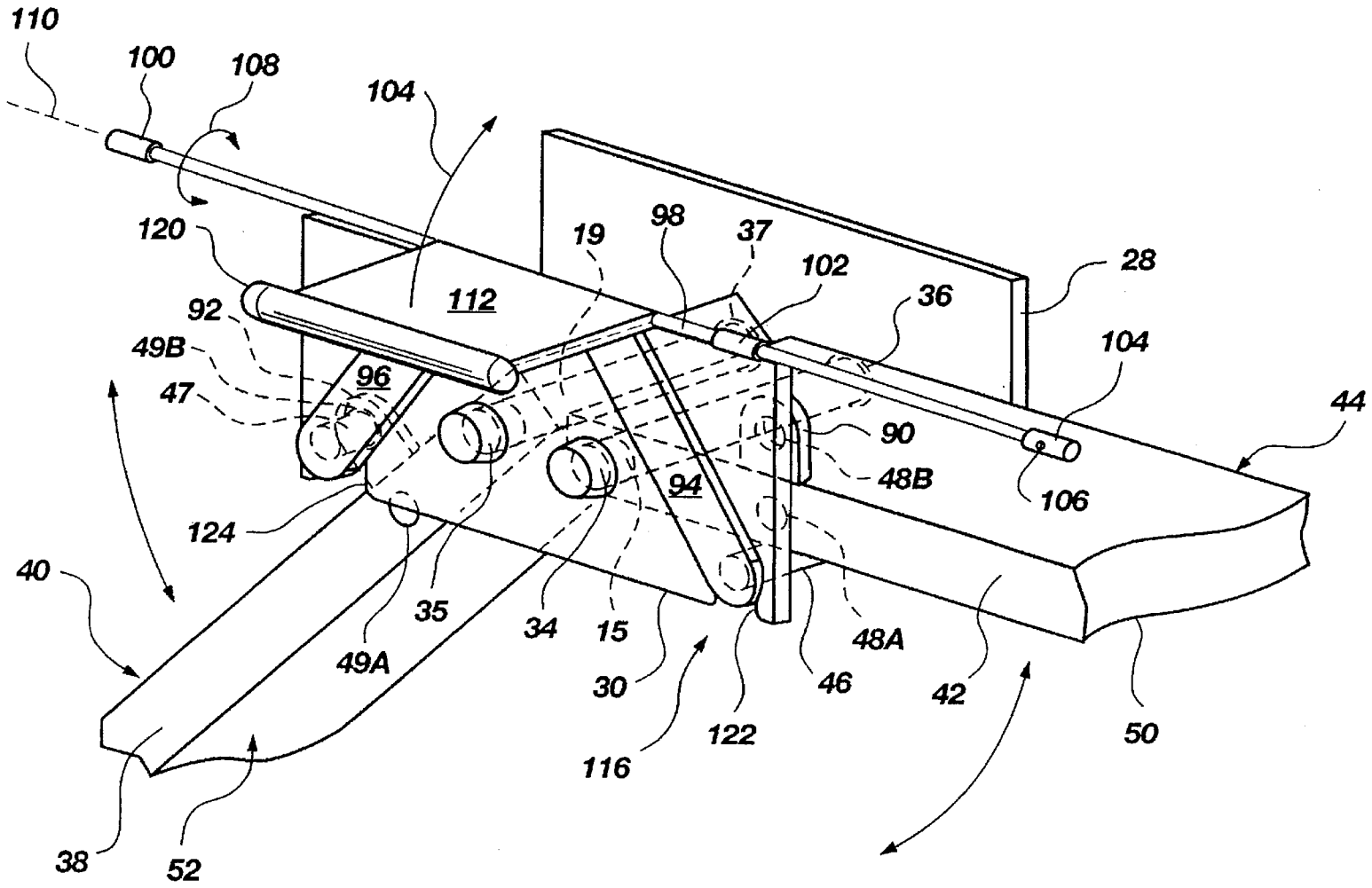
FIG. 5 is a partial perspective of the bracket portion of an exercise bench of FIG. 1.
Figure 6:
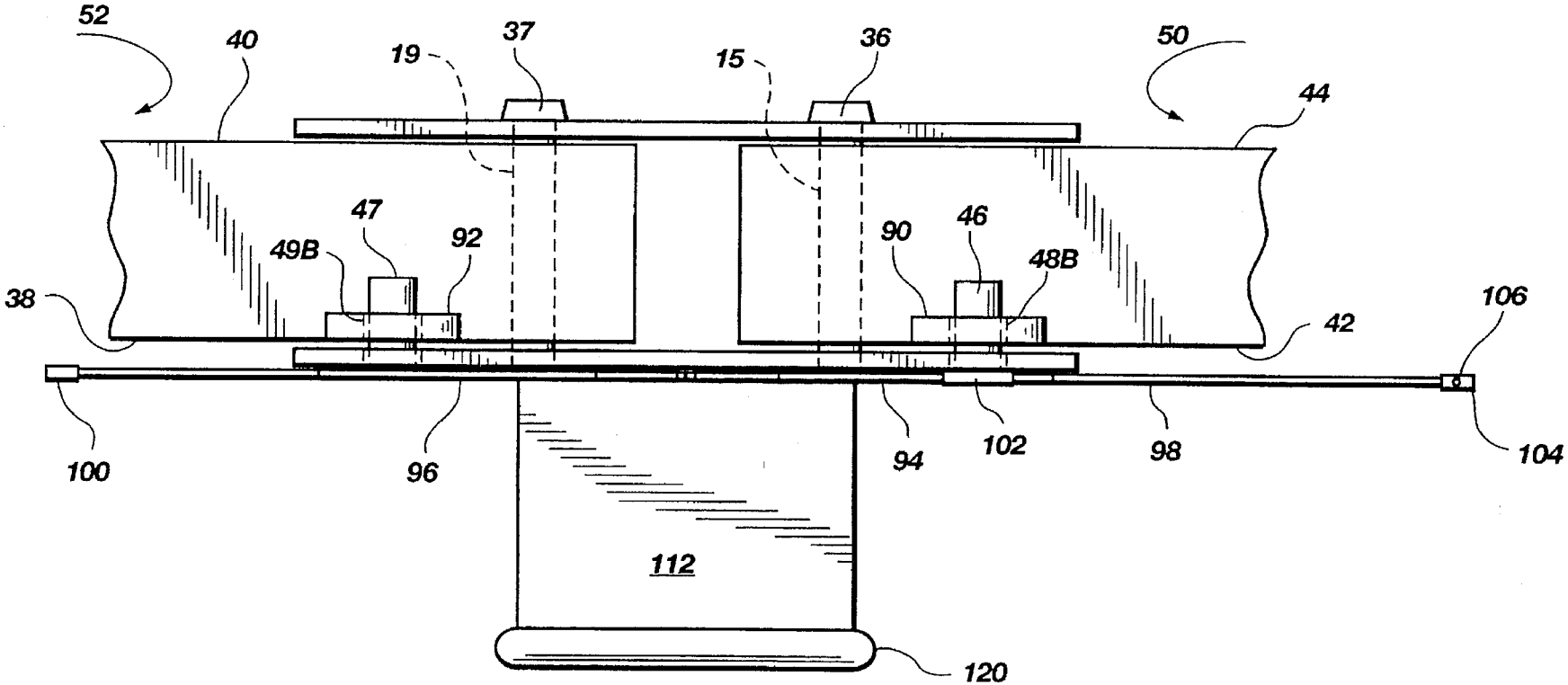
FIG. 6 is a top partial schematic view of the bracket of an exercise bench of FIG. 1.
Figure 7:
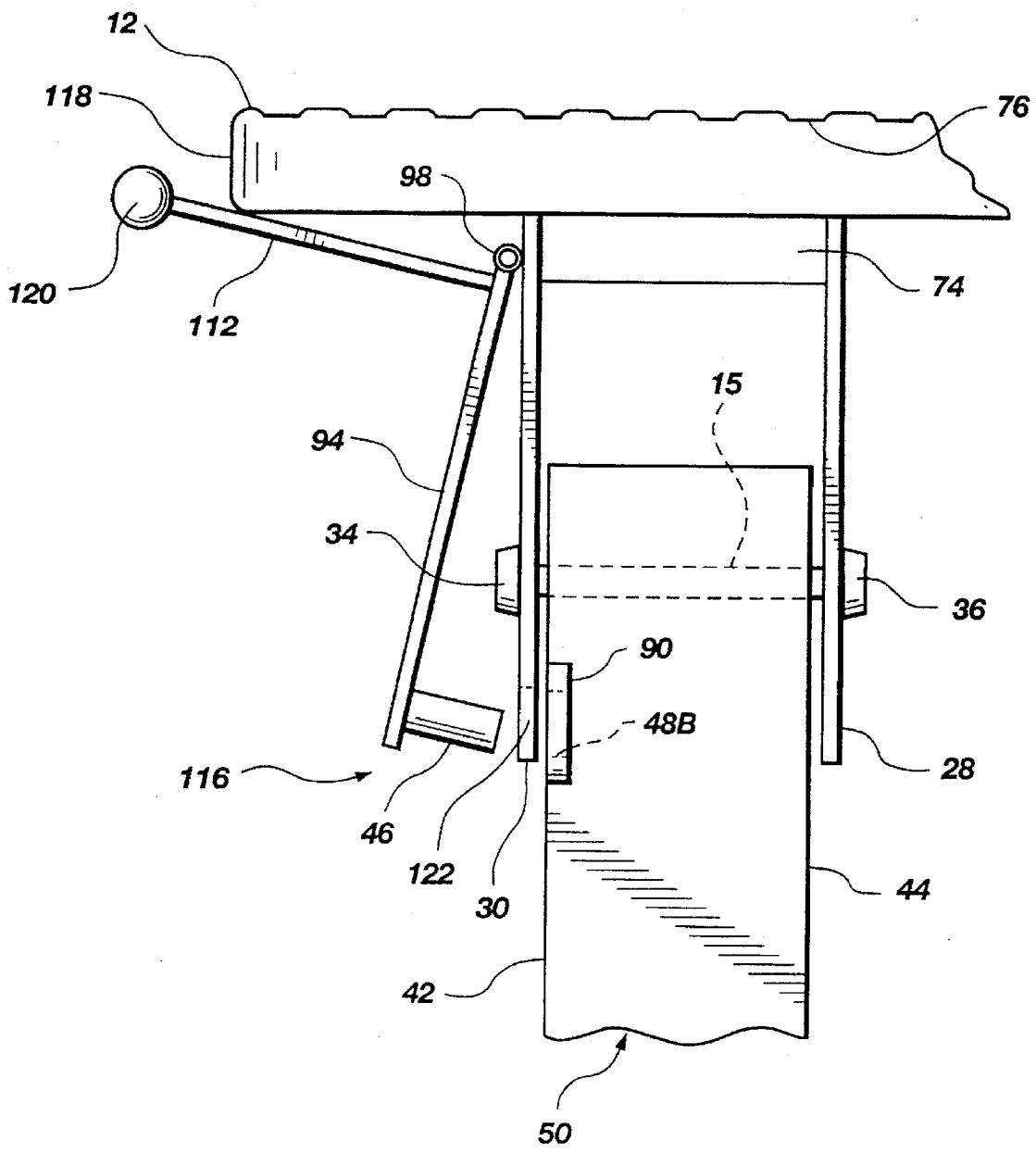
FIG. 7 is a partial side view of the bracket portion of an exercise bench of FIG. 1.

As shown in FIG. 1, left member 30 and right member 28 are spaced apart to receive the first leg member 16 and the second leg member 20 therein between. The leg members 16 and 20 as better seen in FIG. 5, 6 and 7 are configured to rotate about axles 15 and 19. The axle 15 is secured by locking caps 34 and 36. The other axle 19 is secured by locking caps 35 and 37. Other devices and means may be used to lock the axles 15 and 19 to the bracket 14. For example, the axle ends may be swaged, threaded or otherwise configured to retain them in the bracket 14.

The axles 15 and 19 extend through the right member 28 and left member 30 of the bracket as well as corresponding wall members 38 and 40 of the second leg 20 and wall members 42 and 44 of the first leg 16. As can be seen, the walls 38, 40, 42 and 44 are configured with apertures so that right member 28 and left member 30 rotate about their respective axles 15 and 19 and in turn permit rotation of the first leg member 16 and second leg member 20.

Locking pins 46 and 47 are also provided to snugly and slidably register in apertures 48A and 48B associated with the first leg member 16 and corresponding apertures 49A and 49B associated with second leg member 20. The pins 46 and 47 may also register with corresponding surfaces 50 and 52 of the respective leg members 16 and 19 to positioning of the legs 16 and 20 in the second position shown in FIG. 2. In the first position shown in FIG. 2, the legs 16 and 20 are in effect in general alignment or otherwise oriented so the platform 12 is positioned close to the support surface.

In FIG. 3, an alternate first position is shown in which the platform 12 is elevated above the support surface 54 a height 52A which may be selected for performing stepping exercises. In FIG. 4, the platform 12 is shown with the first leg 16 and the second leg 20 positioned in order to orient the platform 12 at an inclination relative to the support surface.

As can be seen from FIG. 4, the platform 12 may be positioned on a support surface 54 proximate a wall 56 or other vertical structure. In turn the user may recline with either his or her chest against the platform 12 or with his or her back against the platform 12 to perform additional exercises. For example with the back leaning against the platform 12 and the buttocks positioned on the support surface 54, the user may perform a variety of leg raising and leg lifting exercises including exercises in which the free weights 58 (FIG. 1) are manipulated or grasped by the user to increase the difficulty of exercises being performed. Similarly, the user may place his or her back on the support surface 54 and his or her legs along the platform 12 to perform sit-up type exercises.

Returning to FIG. 1, it can be seen that the first leg 16 has a plurality of free weights 58 including a first three-pound weight 60, a second three-pound weight 62, a first six-pound weight 64 and a second six-pound weight 66. All are snugly but removably secured in brackets 68 which includes a plurality of ears that extend upwardly from the leg 16 with notches to receive the free weights therein as illustrated. The free weights 58 may be removed by the user and grasped in the user's hands in order to perform a variety of different free weight exercises. For example, they may be held to the chest while performing sit up exercises to increase the resistance or difficulty of an exercise.

As hereinbefore noted, the securing means associated with the bracket 14 operates to lock the leg members 16 and 20 in their respective first positions and second positions. As noted in FIGS. 2, 3 and 4, a variety of other positions may be selected or developed as desired by the user by adding more apertures and by changing the size of the bracket 14 and the location of the axles 15 and 19.

As hereinbefore noted, the platform 12 has an underlying base structure. In FIG. 1, the platform 12 also has a supporting frame member 74. The friction surface 76 associated therewith may be made of neoprene or rubber-like materials to provide an acceptable surface for use in the performance of exercises. In some configuration, the platform 12 may include a cushioned surface in order to provide more comfortable structure for sitting or reclining by the user.

It may be noted that the distal ends 78 and 80 of the right leg member 16 and left leg member 20 respectively have a foot member transversely secured thereto. The first foot member 82 and a second foot member 84 are both respectively preferably sized in width 86 to be at least the width 26 of the platform 12. Desirably, the foot members 82 and 84 may extend beyond the width 26 of the platform 12 to provide a larger footprint to stabilize the platform 12 in use.

It may also be noted that the left leg member 20 and fight leg member 16 each have an axis which are substantially the same and in turn the leg members 16 and 20 may be said to be in substantial axial alignment.

Turning now to FIGS. 5–7, as noted earlier, the securing means of the exercise bench is here shown to include a first retaining member and a second retaining member for contact with a surface of the respective first leg member 16 and second leg member 20. The surface may be the underside 50 and 52 of the respective leg members 16 and 20. The surface may also be the interior surface of apertures such as apertures 48A and 48B and 49A and 49B.

It may be noted that the apertures 48A and 49A are here formed to be cylindrical in form and may be inserted into the leg member 16 and 20. They are sized to easily receive the associated pins 46 and 47.

It may also be noted that the apertures 48B and 49B are formed in metal tabs 90 and 92 attached (for example by welding) to the leg members 16 and 20 as shown. The tabs 90 and 92 are here shown with one aperture 48B and 49B formed in each. However, the tabs 90 and 92 may be made longer or higher with more apertures formed therein if desired.

The pins 46 and 47 are shown connected (for example by welding) to first arm 94 and second arm 96, respectively. The arms 94 and 96 are connected, for example by welding to a torsion bar 98. The torsion bar 98 functions as a spring to urge the arms 94 and 96 and in turn pins 46 and 47 toward the bracket 14 and more particularly left member 30 of the bracket 14. The torsion bar 98 is a relatively thin metal member secured at its left end 100 to the underside of the platform 12. The left end may be secured by bolts, screws or the like including spot welding.

The torsion bar 98 may pass through a guide 102 which is a hollow cylinder sized to rotatably receive the torsion bar 98. The torsion bar 98 may be secured to the underside of the platform 12 at its right end 104 by a screw or rivet 106 or by other suitable fastening means including welding. The torsion bar 98 is thus free to rotate 108 about its longitudinal axis 110. The handle 112 is secured either to the arms 94 and 96 (FIG. 7) or to the torsion bar 98 (FIG. 5). Upon upward movement 114 of the handle 112, the torsion bar 98 rotates to tensionally resist rotation and in turn acts to urge the arms 94 and 96 toward 116 the left member 30 of the bracket 14. The handle 112 is sized in length to extend outwardly for grasping by the user and preferably beyond the outer edge 118 for ease of use. Further to facilitate use, the handle 112 may have a structure 120 to facilitate grasping.

As best seen in FIG. 5, the left member 30 has a right notch 122 and a left notch 124 formed to permit the pins 46 and 47 to easily access the surfaces 50 and 52 as well as apertures 48A, 48B, 49A and 49B as shown.

It may be noted that in use, the legs 16 and 20 may be placed in a variety of positions to perform a variety of different exercises. Further when exercise is completed, the user may configure the exercise bench of FIG. 1 to the configuration schematically shown in FIG. 2 for storage. As can be seen from FIG. 2, the exercise bench may then be readily stored in a closet or underneath a bed or other convenient location as desired by the user.

It may also be noted that the legs 16 and 20 are each tubular in shape and preferably formed of hollow tubular steel or a comparable material sufficient to provide adequate strength for the user in performing the stepping exercises as well as a variety of sitting and reclining exercises. Hollow tubular metal is preferred inasmuch as it provides for increased strength and rigidity. In addition, the proximal ends 70 and 72 of the legs 16 and 20 respectively as shown in FIG. 5 may provide for rotation about a common axle (not shown).

Reference herein to the details of the illustrated embodiment is not intended to restrict the scope of the appended claims which themselves recite those features which are regarded as essential to the invention.

What is claimed is:

1. An exercise bench comprising:

a unitary platform formed and sized to support a user performing exercises thereon when the user is upright and not upright;

a bracket mechanically associated with said platform;

first leg means having a first end rotatably connected to said bracket and a second end configured for placement on a support surface, said first leg means being moveable between a first in use position and a second in use position rotatably spaced from said first in use position;

second leg means having a first end rotatably connected to said bracket and a second end configured for placement on a support surface, said second leg means being moveable between a first in use position and a second in use position rotatably spaced from said first in use position; and securing means for separately and removably securing said first leg means and said second leg means each in one of said first in use positions and said second in use positions respectively.

2. The exercise bench of claim 1, wherein said first leg means includes a first leg member with a first foot member attached proximate the distal end thereof.

3. The exercise bench of claim 2, wherein said second leg means includes a second leg member with a second foot member attached proximate the distal end thereof.

4. The exercise bench of claim 3, wherein said securing means includes a first axle and a second axle each associated with said bracket, wherein said first leg member is configured to rotate about said first axle and wherein said second leg member is configured to rotate about said second axle.

5. The exercise bench of claim 4, wherein said securing means includes a first retaining member for retaining said first leg means in at least said first position and wherein said first leg means has a surface for contact with said first retaining member.

6. The exercise bench of claim 5, wherein said securing means includes a second retaining member for retaining said second leg means in at least said first position and wherein said second leg means has a surface for contact with said second retaining member.

7. The exercise bench of claim 6, wherein said surface of said first leg member includes at least one first aperture mechanically associated therewith wherein said surface of said second leg member includes at least one second aperture mechanically associated therewith wherein said first retaining member is a first pin for removable connection with said first aperture for securing said first leg member in said first position, and wherein said second retaining member is a second pin for removable connection with said second aperture for securing said second leg member in said first position.

8. The exercise bench of claim 7, wherein said first pin is connected to a first arm and wherein said securing means includes spring means positioned to urge said first pin into registration with said first aperture.

9. The exercise bench of claim 8, wherein said second pin is connected to a second arm and wherein said securing means includes spring means positioned to urge said second pin into registration with said second aperture.

10. The exercise bench of claim 7, wherein said securing means includes a handle positioned for operation by the user and connected to said first arm and said second arm to move said first pin and said second pin from and into registration with said first aperture and said second aperture respectively.

11. The exercise bench of claim 9, wherein said spring means is a torsion bar secured at its opposite ends to said platform; and wherein said first arm and said second arm are connected to said torsion bar.

12. The exercise bench of claim 11, wherein said first leg means and said second leg means are in general axial alignment.

13. The exercise bench of claim 12, wherein said first leg member is tubular and wherein said first foot member extends transverse to said first leg member.

14. The exercise bench of claim 13, wherein said second leg member is tubular and wherein said second foot member extends transverse to said second leg member.

15. The exercise bench of claim 14, wherein said platform has a length and a width and is generally rectilinear in projection.

16. The exercise bench of claim 15, wherein said first foot member and said second foot member are each sized to extend at least the width of said platform.

17. The exercise bench of claim 16, wherein said first leg member and said second leg member are each sized in length to extend together proximate the length of said platform when in said second position.

18. The exercise bench of claim 1, wherein said first leg means has a plurality of brackets sized to snugly and removably receive a plurality of hand exercise weights.

19. The exercise bench of claim 4, wherein said first axle and said second axle are the same axle.

20. The exercise bench of claim 18, wherein said platform is sized in width from about eighteen inches to about twenty-four inches and in length from about thirty inches to about thirty-six inches.

21. The exercise bench of claim 14, wherein said first foot member and said second foot member are sized in width to define a foot print to stably support said platform in use.

22. An exercise bench comprising:

a platform formed and sized to support a user performing exercises thereon;

a bracket secured to said platform;

first leg means having a first end rotatably connected to said bracket and a second end configured for placement on a support surface, said first leg being moveable between a first position and a second position rotatably spaced from said first position;

second leg means having a first end rotatably connected to said bracket and a second end configured for placement on a support surface, said second leg means being moveable between a first position and a second position rotatably spaced from said first position; and securing means for removably securing said first leg means and said second leg means in said first position and said second position respectively, said securing means including, first contact structure associated with said first leg means, second contact structure associated with said second leg means, a first pin for removable association with said first contact structure in one of said first position and said second position, a second pin for removable association with said second contact structure in one of said first position and said second position, a first arm connected to said first pin, a second arm connected to said second pin, spring means to urge said first pin and said second pin into removable association with said first contact structure and said second contact structure respectively, and a handle connected to said first arm and said second arm for operation by a user to urge said first pin and said second pin from association with said first contact structure.

23. The exercise bench of claim 22, wherein said fist contact structure includes an aperture formed in said first leg means.

24. The exercise bench of claim 23, wherein said second contact structure includes an aperture formed in said second leg means.

25. The exercise bench of claim 24, wherein said first contact structure includes a surface of said first leg means and said second contact structure includes a surface of said second leg means.

26. The exercise bench of claim 25, further including a torsion bar secured at its opposite ends to said platform; and wherein said first arm and said second arm are connected to said torsion bar.

27. The exercise bench of claim 26, wherein said first leg means has a plurality of brackets sized to snugly and removably receive a plurality of hand exercise weights.

28. An exercise bench comprising:

a unitary platform formed and sized to support a user performing exercises thereon when the user is upright and not upright;

a bracket mechanically associated with said platform;

first leg means having a first end rotatably connected to said bracket and a second end configured for placement on a bench support surface, said first leg means being moveable between a first position and a second position rotatably spaced from said first position;

second leg means having a first end rotatably connected to said bracket and a second end configured for placement on the bench support surface, said second leg means being moveable between a first position and a second position rotatably spaced from said first position; and securing means for separately and removably securing said first leg means and said second leg means each in one of said first positions and said second positions respectively.

29. An exercise bench comprising:

a unitary platform formed and sized to support a user performing exercises thereon when the user is upright and not upright;

a bracket mechanically associated with said platform;

first leg means having a first end rotatably connected to said bracket and a second end configured for placement on a support surface, said first leg means including a first first leg means having a first end rotatably connected to said bracket and a second end configured for placement on a support surface, said first leg means including a first leg member with a first foot member attached proximate the distal end thereof, said first leg member being moveable between a first position and a second position rotatably spaced from said first position;

second leg means having a first end rotatably connected to said bracket and a second end configured for placement on the support surface, said second leg means being moveable between a first position and a second position rotatably spaced from said first position; and securing means for separately and removably securing said first leg member and said second leg means each in one of said first positions and said second positions respectively.

30. An exercise bench comprising:

a unitary platform formed and sized to support a user performing exercises thereon when the user is upright and not upright;

first leg means having a first end mechanically associated with said unitary platform to be rotatable and a second end configured for placement on a bench support surface, said first leg means being moveable between a first position and a second position rotatably spaced from said first position;

second leg means having a first end mechanically associated with said unitary platform to be rotatable and a second end configured for placement on the bench support surface, said second leg means being moveable between a first position and a second position rotatably spaced from said first position; and securing means for separately and removably securing said first leg means and said second leg means each in one of said first positions and said second positions respectively.

* * * * *